US006798632B1

(12) United States Patent
Holmes et al.

(10) Patent No.: US 6,798,632 B1
(45) Date of Patent: Sep. 28, 2004

(54) POWER FREQUENCY ELECTROMAGNETIC FIELD COMPENSATION SYSTEM

(75) Inventors: John J. Holmes, Columbia, MD (US); John F. Scarzello, Columbia, MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 126 days.

(21) Appl. No.: 10/171,761

(22) Filed: Jun. 13, 2002

(51) Int. Cl.[7] ..... H01F 13/00
(52) U.S. Cl. ..... 361/143; 143/146
(58) Field of Search ..... 361/143, 149, 361/146; 324/247

(56) References Cited

U.S. PATENT DOCUMENTS

| | | | | |
|---|---|---|---|---|
| 3,110,282 A | * | 11/1963 | Foerster | 114/240 R |
| 3,801,877 A | * | 4/1974 | Griese et al. | 361/146 |
| 4,302,746 A | | 11/1981 | Scarzello et al. | |
| 4,323,900 A | | 4/1982 | Krall et al. | |
| 4,734,816 A | * | 3/1988 | Guillemin et al. | 361/149 |
| 5,038,103 A | | 8/1991 | Scarzello et al. | |
| 5,189,590 A | | 2/1993 | Schneider | |
| 5,440,232 A | | 8/1995 | Scarzello et al. | |
| 5,463,523 A | | 10/1995 | Holmes et al. | |
| 5,465,012 A | * | 11/1995 | Dunnam | 307/91 |
| 5,483,410 A | | 1/1996 | Holmes et al. | |
| 5,598,152 A | | 1/1997 | Scarzello et al. | |
| 5,644,397 A | * | 7/1997 | Blake | 356/483 |
| 5,886,661 A | | 3/1999 | Harrison et al. | |
| 6,208,268 B1 | | 3/2001 | Scarzello et al. | |
| 6,278,272 B1 | | 8/2001 | Scarzello et al. | |
| 6,344,743 B1 | | 2/2002 | Holmes et al. | |
| 6,459,194 B1 | * | 10/2002 | Akita | 313/402 |

OTHER PUBLICATIONS

Robert A. Wingo, John J. Holmes, and Milton H. Lackey, "Test Of Closed–Loop Degaussing Algorithm On A Minesweeper Engine," *Naval Engineers Journal* (Proceedings of 1992 ASNE Conference), May 1992.

* cited by examiner

*Primary Examiner*—Gregory J. Toatley, Jr.
*Assistant Examiner*—Z Kitov
(74) *Attorney, Agent, or Firm*—Howard Kaiser

(57) ABSTRACT

The electromagnetic field produced by an electrical device is electromagnetically canceled by a three-dimensional configuration of electrical coils which together provide a box-like enclosure having at least six sides/faces. The electromagnetic containment of the electromagnetic field is effected via the physical occurrence of zero magnetic flux perpendicularly through each side/face. At least one coil is positioned in correspondence with each side/face of the box-like enclosure. Each coil has a set of conductors divided into two halves in terms of circuitry, the conductors in each half being connected to each other in series. With regard to each coil, a first amplifier receives an electrical signal from the first conductor half and outputs to a second amplifier a voltage signal proportional to the AC magnetic flux through the coil. The second amplifier inputs a current signal to the second conductor half so as to render nonexistent the first amplifier's output voltage signal.

16 Claims, 7 Drawing Sheets

POWER FREQUENCY ELECTROMAGNETIC FIELD COMPENSATION SYSTEM

STATEMENT OF GOVERNMENT INTEREST

The invention described herein may be manufactured and used by or for the Government of the United States of America for governmental purposes without the payment of any royalties thereon or therefor.

BACKGROUND OF THE INVENTION

The present invention relates to methods and apparatuses for degaussing, more particularly to methods and apparatuses for degaussing AC electrical equipment such as may be used aboard marine vessels.

There is a trend in the maritime industry toward electric propulsion. The U.S. Navy anticipates the conversion of some of its ships to "all-electric" ships. For example, large, high-power electric generators and motors will be used onboard to propel the naval vessels. High-current motors and generators can generate large magnetic fields at extremely low frequencies including 60 Hz and harmonics (power frequencies), some of which may leak out of the machine or system and into the surrounding water. These fields can be availed of by underwater mines, torpedoes and surveillance systems for detecting the presence of the vessel, and/or for detonation of explosives. In addition, the leakage fields may interfere with important shipboard systems.

One proper approach to reducing the leakage fields (stray fields) from high-power shipboard devices would be to design the systems according to previously established guidelines. See, e.g., "Design of Electrical Equipment with Small Stray Magnetic Fields", Military Handbook, MIL-HDBK-802 (SH), Jul. 2, 1990, incorporated herein by reference. However, technical and cost constraints may prevent the stray fields from being reduced down to acceptable amplitudes. To further reduce the power frequency electromagnetic emanations from onboard electrical systems will require active cancellation of the stray fields.

Degaussing systems—including, more specifically, Closed-Loop Degaussing (CLDG) systems—have been designed to automatically monitor and compensate the static magnetic field signatures of ships produced by the ferromagnetic material used in its construction. See, e.g., R. A. Wingo, J. J. Holmes, and M. H. Lackey, "Test Of Closed-Loop Degaussing Algorithm On A Minesweeper Engine," Proceedings of 1992 ASNE Conference, May, 1992, incorporated herein by reference. See also U.S. Pat. No. 5,189,590 to Carl S. Schneider issued February 23, 1993 entitled "Closed-Loop Multi-Sensor Control System and Method," incorporated herein by reference. The CLDG system is comprised of many static magnetic field sensors (magnetometers), placed throughout the ship, which measure the fields at specific points and then transmit their data to a central computer. Using a special signature prediction algorithm, the CLDG controller computes required changes in degaussing coil currents that will re-optimize the vessel's signature when changes in its residual magnetization have occurred.

A typical CLDG system is very limited in bandwidth as well as in spatial fidelity for purposes of controlling and canceling magnetic fields. The CLDG system's sensors, data communication network, controlling computer and degaussing coil design are not even remotely characterized by that which would be required for a power frequency electromagnetic field cancellation system, viz., a wideband digital network comprising a high speed computer along with a large number of wideband sensors and compensating coils. Implementation of this kind of digital network would be impractical in shipboard applications.

SUMMARY OF THE INVENTION

In view of the foregoing, it is an object of the present invention to provide method and apparatus for actively reducing or canceling the extremely low frequency (including but not limited to 60 Hz and harmonics) electromagnetic fields generated by shipboard electrical and electromechanical systems (e.g., electric motors and generators).

It is a further object of the present invention to provide such method and apparatus which are practical and economical.

The present invention obviates the need for a wideband digital network including a high-speed computer. Instead, the present invention features the use of small, localized sensing and compensating coils, and further features analogue control thereof In accordance with many embodiments of the present invention, degaussing apparatus comprises at least four coil units for bordering upon an electrical device so that the respective imaginary planes defined by the coil units together form an imaginary enclosure for the device. Each coil unit includes plural conductors so that at least one conductor is adaptable to connection with a first amplifier for sensing the magnetic flux associated with the device and producing a voltage proportional to the magnetic flux, and so that at least one other conductor is adaptable to connection with a second amplifier for producing a current which neutralizes the magnetic flux. The total or overall effect of these neutralizations of the magnetic flux is to prevent the escape of any magnetic flux from the imaginary enclosure.

A typical embodiment of a power frequency electromagnetic field compensation system in accordance with the present invention comprises an active feedback control system which cancels the electromagnetic field radiating from electromechanical devices (electric motors, generators, control systems, distribution systems, etc.) at a given frequency (e.g., a frequency of 60 Hz), and which also cancels the harmonics of the electromagnetic field. According to frequent inventive practice, the source of the power frequency electromagnetic field (e.g., a motor, a generator, etc.) is completely surrounded by a minimum of three pairs of coils, one pair in each orthogonal direction, wherein each coil comprises at least one multi-conductor cable. In each cable, a first half of the conductors are connected in series, and a second half of the conductors are separately connected in series, thereby forming two independent circuits. The first circuit acts as an induction sensor (sensing coil), the output of which is proportional to the rate-of-change in the magnetic field, while the second circuit acts as a compensation coil to cancel the AC flux passing through the loop formed by the cable. An analogue feedback electronics device drives the second circuit with current so as to force the output voltage of the first circuit to zero. In this way, the total power frequency electromagnetic field emanating from the electromechanical device is cancelled.

The present invention affords several advantages and new features vis-a'-vis what is presently achieved or achievable with the static magnetic Closed-Loop Degaussing (CLDG) system. Firstly, unlike the CLDG system, state-vectors for the power frequency electromagnetic field compensation system do not have to be measured or computed according to the present invention. Establishing CLDG state-vectors empirically is a time-consuming and labor-intensive process.

In addition, CLDG systems have to be re-calibrated periodically. In contrast, according to the present invention, once the gains of the amplifiers in the power frequency electromagnetic field compensation system are set (e.g., through the use of a controller), no further calibration or re-calibration is required.

Moreover, a conventional CLDG system requires state-vectors for virtually every circuit configuration and current distribution that could be found inside the electromechanical system being compensated. By comparison, the present invention's power frequency electromagnetic field compensation system does not need any state-vectors. Therefore, the inventive compensation system can automatically compensate for any changes in current distribution that may occur inside its controlled volume.

Furthermore, generally speaking, it would be difficult or impractical to endow a CLDG system with power frequency electromagnetic field compensation capabilities. Factors such as the bandwidth, sensor dynamic range, number of data channels and update rate of a kind of power frequency electromagnetic field compensation system which could be associated in theory with a CLDG system would be too demanding for the digital data acquisition, transmission and compensation control system characterizing the CLDG system. In accordance with the present invention, a plural number of small, localized, collocated, analogue sensing and compensating coils avoids the drawbacks of a wideband digital network and high-speed computer. Although it would not be impossible to construct a digital power frequency electromagnetic field compensation system in association with a CLDG system, it is believed that the present invention's distributed analogue system will generally prove to be more reliable and cost effective.

Other objects, advantages and features of this invention will become apparent from the following detailed description of the invention when considered in conjunction with the accompanying drawings.

BRIEF DESCRIPTION OF THE DRAWINGS

In order that the present invention may be clearly understood, it will now be described, by way of example, with reference to the accompanying drawings, wherein like numbers indicate the same or similar components, and wherein.

DETAILED DESCRIPTION OF THE INVENTION

Figure 1:
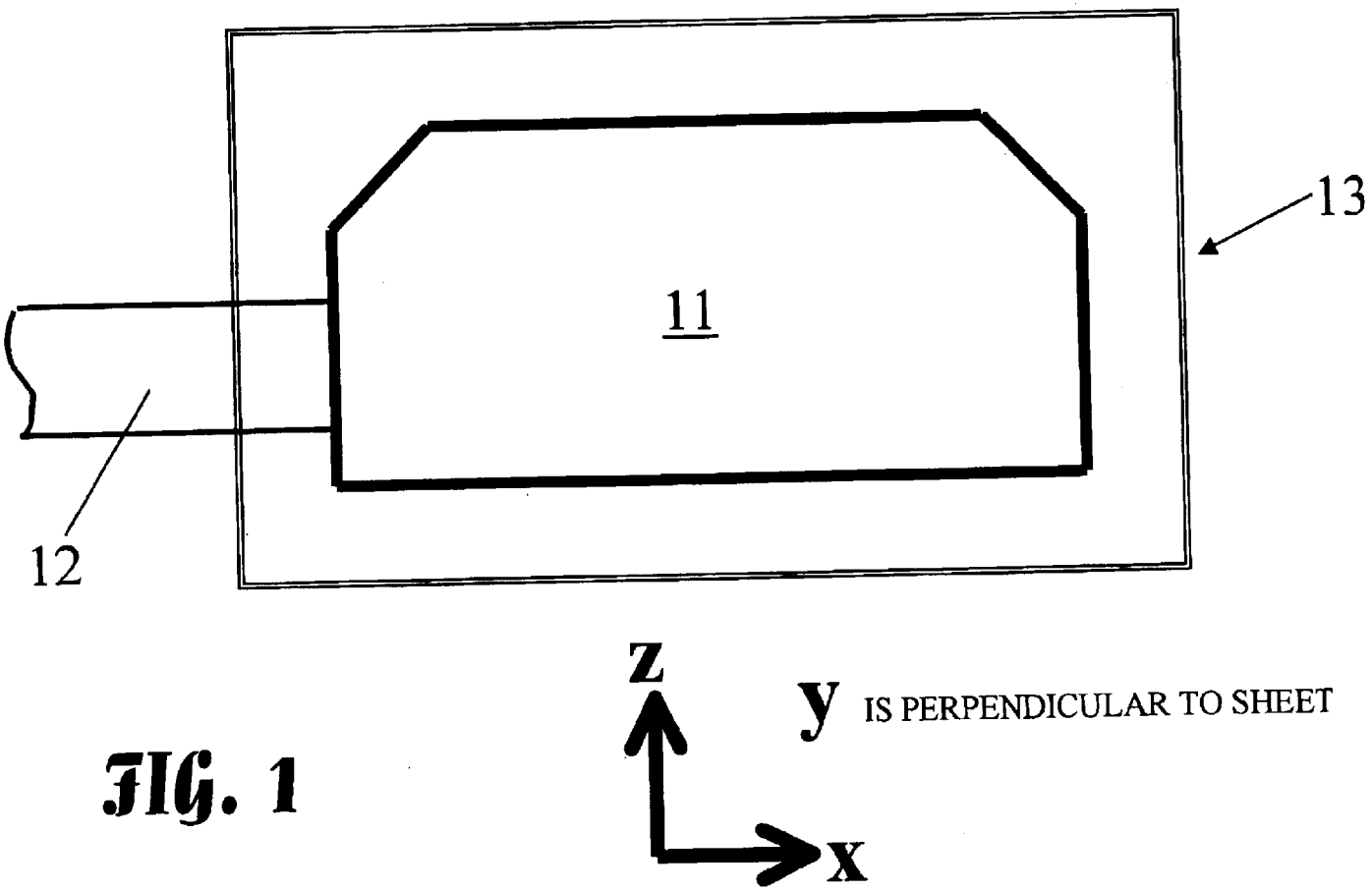
FIG. 1 is a diagrammatic side elevation view of an electrical device (e.g., generator or motor) and a closed-circuit cable in accordance with the present invention, particularly illustrating typical inventive practice wherein one of two closed-circuit cables each lie in an x-z plane, and wherein the two x-z-oriented closed-circuit cables are similarly situated at opposite extremities taken along the y axis of the electrical device.
Figure 2:
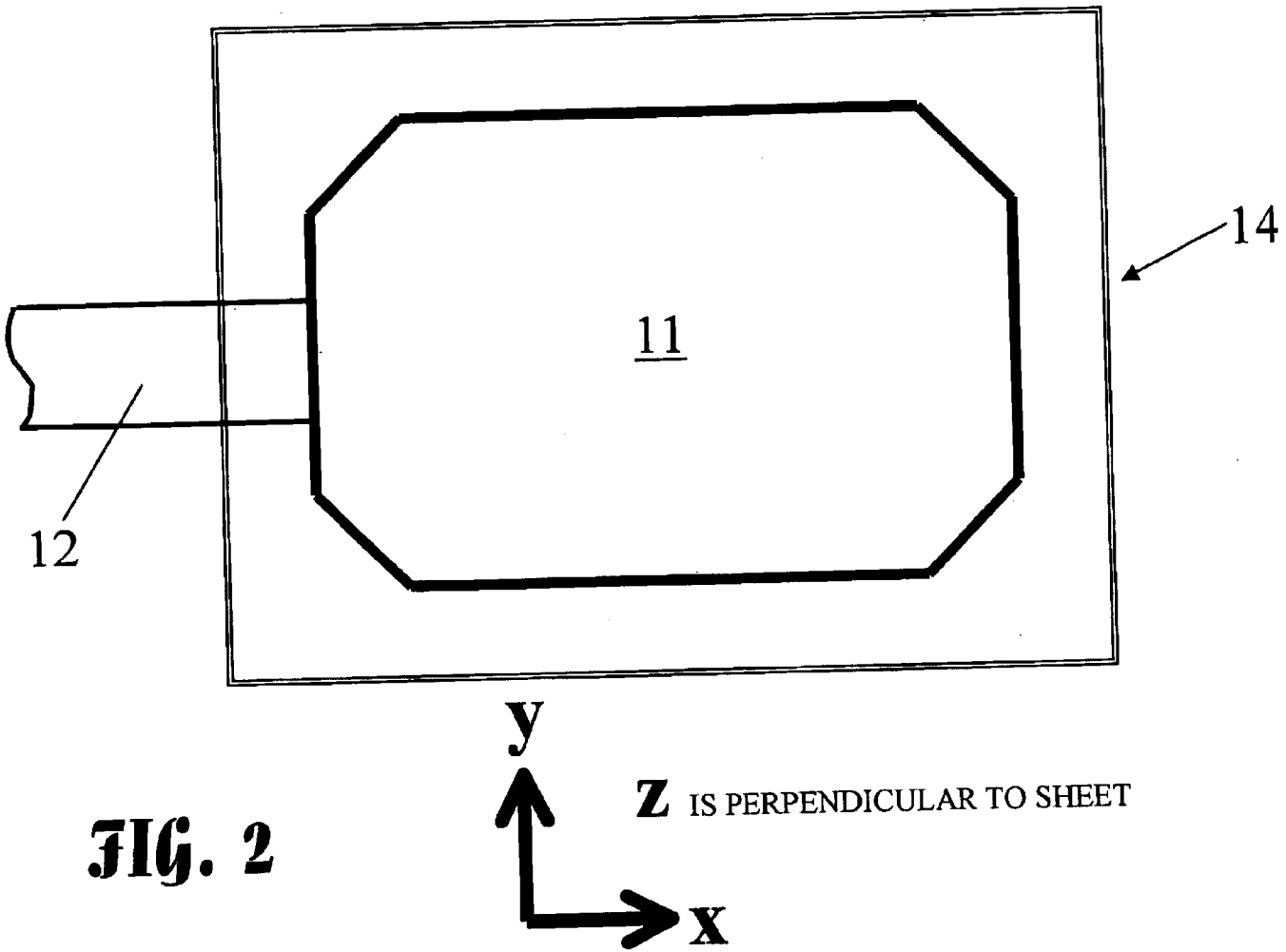
FIG. 2 is a diagrammatic top plan view of the electrical device shown in FIG. 1 and a closed-circuit cable in accordance with the present invention, particularly illustrating typical inventive practice wherein one of two closed-circuit cables each lie in an x-y plane, and wherein the two x-y-oriented closed-circuit cables are similarly situated at opposite extremities taken along the z axis of the electrical device.
Figure 3:
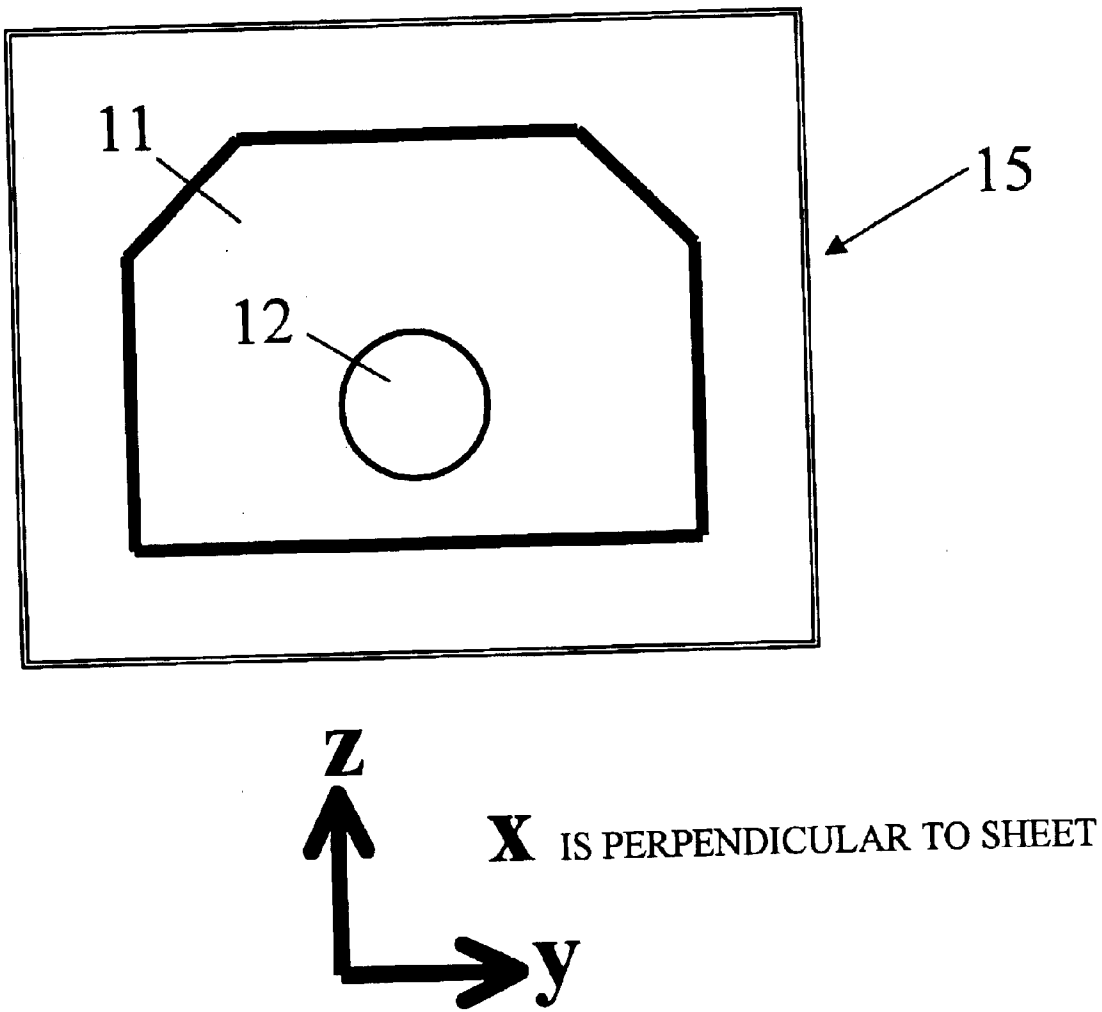
FIG. 3 is a diagrammatic end elevation view of the electrical device shown in FIG. 1 and a closed-circuit cable in accordance with the present invention, particularly illustrating typical inventive practice wherein one of two closed-circuit cables each lie in a y-z plane, and wherein the two y-z-oriented closed-circuit cables are similarly situated at opposite extremities taken along the x axis of the electrical device.
Figure 4:
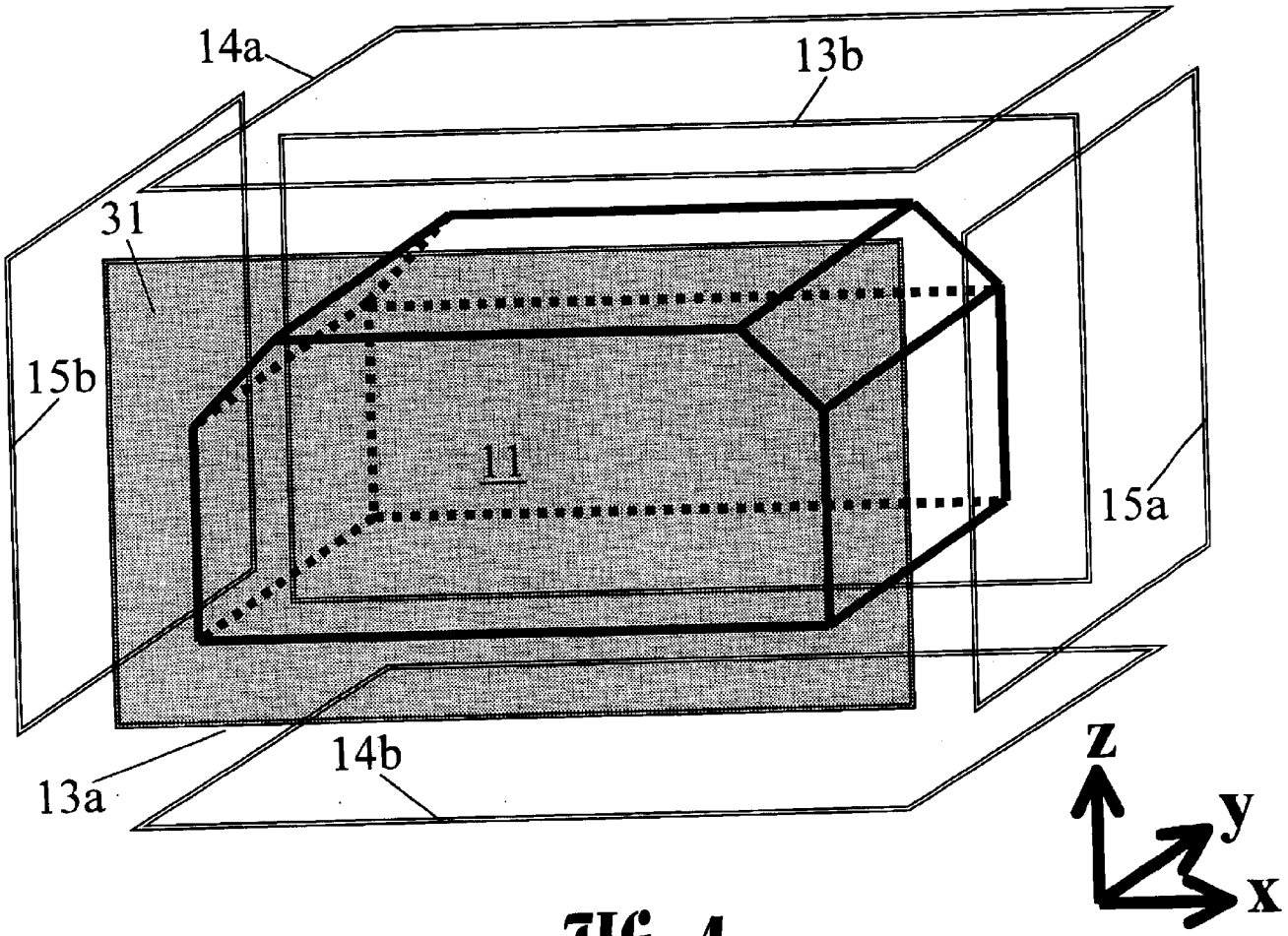
FIG. 4 is a diagrammatic perspective view (sans mechanical shaft) of the electrical device shown in FIG. 1 and six closed-circuit cables in accordance with the present invention, particularly illustrating typical inventive practice combining inventive features shown in FIG. 1, FIG. 2 and FIG. 3, wherein three pairs of closed-circuit cables are situated as follows: (i) two x-z-oriented closed-circuit cables are similarly situated at opposite extremities taken along the y axis of the electrical device, (ii) two x-y-oriented closed-circuit cables are similarly situated at opposite extremities taken along the z axis of the electrical device; and, (iii) two y-z-oriented closed-circuit cables are similarly situated at opposite extremities taken along the x axis of the electrical device.
Figure 5:
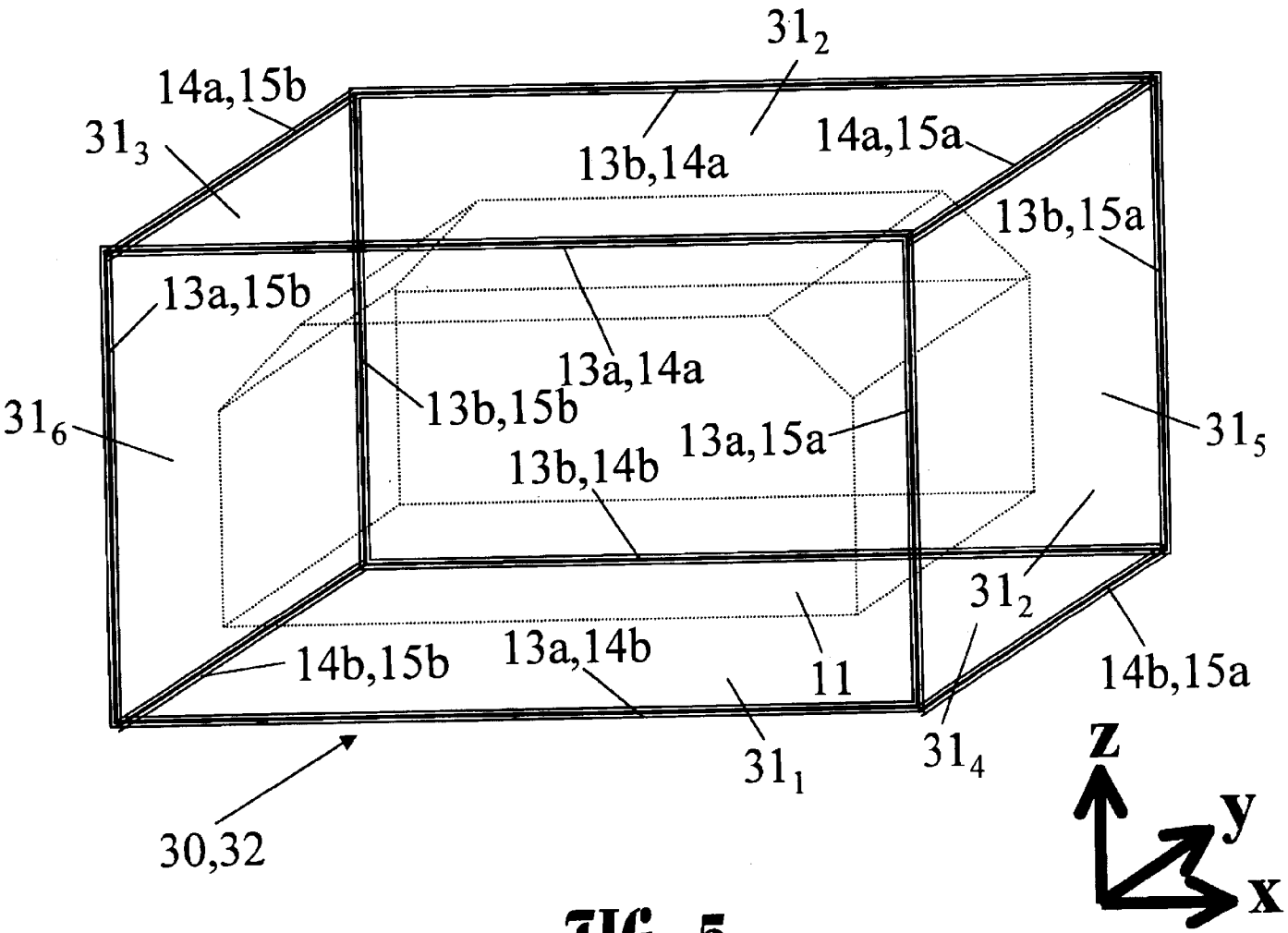
FIG. 5 is a view, similar to the view shown in FIG. 4, of the electrical device and six inventive closed-circuit cables shown in FIG. 4, particularly illustrating how, according to typical inventive practice, the six closed-circuit cables define or essentially define together, in terms of electromagnetic physics, a closed three-dimensional geometric figure having a volumetric space therein wherein the electrical device is situated.

Referring now to the figures, the present invention's power frequency signature compensation system, in one of its simpler configurational modes, provides for the placement of a triaxial set of coils around the item or system to be compensated. FIG. 1 through FIG. 5 are illustrative of such an arrangement. FIG. 1, FIG. 2 and FIG. 3 depict, respectively, a lengthwise vertical parallel pair of multi-conductor cable 13 loops, a horizontal parallel pair of multi-conductor cable 14 loops, and a widthwise vertical parallel pair of multi-conductor cable 15 loops. As depicted in FIG. 4 and FIG. 5, each cable loop pair is oriented orthogonally with respect to the other two cable loop pairs. An electrical device 11, such as an electric motor or electric generator, is the entity to be compensated. Electric motor/generator 11 has associated therewith a mechanical shaft 12. For purposes of the example of the present invention described herein with reference to the figures, it is assumed that the wavelength of the electromagnetic field being compensated is much greater than the largest dimension of any sensing/compensating loop.

As individually shown in FIG. 1 through FIG. 3 and as collectively shown in FIG. 4 and FIG. 5, the three parallel pairs of cables 13/14/15 loops are orthogonally disposed with respect to each other and are exteriorly disposed with respect to the object of interest, viz., electric motor/generator 11. FIG. 1 through FIG. 3 each show one of two paired cables, with the understanding in each of these figures that the unshown cable paired therewith is equivalent thereto and is correspondingly disposed on the opposite side of electric motor/generator 11. FIG. 4 and FIG. 5 each show all six cables 13/14/15 (i.e., all three pairs of cables, viz., cables 13*a* and 13*b*, cables 14*a* and 14*b*, cables 15*a* and 15*b*).

Each sensing and compensating cable 13/14/15 loop is situated in the vicinity of a side or surface of motor/generator 11 and slightly forward thereof In other words, the geometric plane defined by each sensing/compensating cable 13/14/15 loop is shown to be slightly outside of electric motor/generator 11, next to and approximately parallel with the geometric plane defined by the adjacent side/surface of motor/generator 11. Each sensing/compensating cable 13/14/15 loop is larger than the corresponding dimension of motor/generator 11. In other words, as shown in FIG. 1 through FIG. 5, although the geometric plane defined by each sensing/compensating cable 13 loop does not intersect motor/generator 11, each sensing/compensating cable 13/14/15 loop would circumscribe motor/generator 11 if the geometric plane defined thereby did intersect motor/generator 11.

Box-shaped enclosure 30, defined by the finite geometric planes defined by cables 13/14/15, functions as a three-dimensional "electromagnetic control surface." In general, the larger the cables 13/14/15 loops relative to the size of motor/generator 11, the more completely the box-shaped enclosure 30 defined thereby will envelop motor/generator 11. Generally corollary thereto, the more completely the box-shaped enclosure 30 defined by the cables 13/14/15 loops envelops motor/generator 11, the less magnetic flux emanating from motor/generator 11 will be permitted to escape the box-shaped enclosure 30. FIG. 4 is tantamount to FIG. 5, except that FIG. 4 for illustrative purposes shows separation of the planar shapes defined by the cables 13/14/15 loops. The voids or spaces revealed in FIG. 4 between cable 13/14/15 imaginary finite planar shapes revealed in FIG. 4 at the junctional edges or corners of these imaginary finite planar shapes are susceptible to leakage of magnetic flux. A similar kind of magnetic flux leakage could occur regardless of whether these junctional spaces or openings are attributable to spatial separation of the cables 13/14/15 or to small size of one or more cables 13/14/15 relative to motor/generator 11.

As shown in FIG. 4 and FIG. 5, multi-conductor electric cables 13*a* and 13*b* represent a first pair of sensing/compensating loops, one placed forward of and the other placed aft of motor/generator 11 in the y-axial direction, and serve to cancel the power frequency electromagnetic fields in the same y-axial direction (i.e., along said y-axis). Multi-conductor electric cables 14*a* and 14*b* represent a second pair of sensing/compensating loops, one placed forward of (e.g., above) and the other placed aft of (e.g., below) motor/generator 11 in the z-axial direction, and serve to cancel the power frequency electromagnetic fields in the same z-axial direction (i.e., along said z-axis). Multi-conductor electric cables 15*a* and 15*b* represent a third pair of sensing/compensating loops, one placed forward of (e.g., to the left of) and the other placed aft of (e.g., to the right of) motor/generator 11 in the x-axial direction, and serve to cancel the power frequency electromagnetic fields in the same x-axial direction (i.e., along said x-axis).

FIG. 1 shows a loop of multi-conductor cable 13 oriented in an x-z plane—that is, in a vertical direction. There is a second cable 13 loop (not shown in FIG. 1) of the same dimensions placed symmetrically, in relation to electric motor/generator 11 and the first (shown) cable 13 loop, at the opposite side of electric motor/generator 11. The vertical pair of cable 13 loops will be used to cancel the power frequency electromagnetic fields of motor/generator 11 along the y-axis, viz., the imaginary axis perpendicular to the x-z planar orientation and connecting the two cable 13 loops (e.g., the "athwartship" axis in a marine application). As shown in FIG. 4, the two paired cables 13*a* and 13*b* are dimensionally and positionally congruous, each oriented in an x-z plane and similarly positioned in the vicinity of a side or end surface or portion of motor/generator 11.

FIG. 2 shows a loop of multi-conductor cable 14 oriented in an x-y plane—that is, in a horizontal direction perpendicular to the vertical direction of the x-z plane shown in FIG. 1, as well as perpendicular to the vertical direction of the the y-z plane shown in FIG. 3. There is a second cable 14 loop (not shown in FIG. 2) of the same dimensions placed symmetrically, in relation to electric motor/generator 11 and the first (shown) cable 14 loop, at the opposite side of electric motor/generator 11. The horizontal pair of cable 14 loops will be used to cancel the power frequency electromagnetic fields of motor/generator 11 along the z-axis, viz., the imaginary axis perpendicular to the x-y planar orientation and connecting the two cable 14 loops). As shown in FIG. 4, the two paired cables 14*a* and 14*b* are dimensionally and positionally congruous, each oriented in an s-y plane and similarly positioned in the vicinity of a side or end surface or portion of motor/generator 11.

FIG. 3 shows a loop of multi-conductor cable 15 oriented in a y-z plane—that is, in a vertical direction perpendicular to the vertical direction of the x-z plane shown in FIG. 1, as well as perpendicular to the horizontal direction of the the x-y plane shown in FIG. 2. There is a second cable 15 loop (not shown in FIG. 1) of the same dimensions placed symmetrically, in relation to electric motor/generator 11 and the first (shown) cable 15 loop, at the opposite side of electric motor/generator 11. The vertical pair of cable 15 loops will be used to cancel the power frequency electromagnetic fields of motor/generator 11 along the i-axis, viz., the imaginary axis perpendicular to the y-z planar orientation and connecting the two cable 15 loops. As shown in FIG. 4, the two paired cables 15*a* and 15*b* are dimensionally and positionally congruous, each oriented in a y-z plane and similarly positioned in the vicinity of a side or end surface or portion of motor/generator 11.

As shown in FIG. 4 and FIG. 5, cables 13*a* and 13*b* are x-z planarly oriented and are used to cancel the power frequency electromagnetic fields in the direction of the y axis; cables 14*a* and 14*b* are x-y planarly oriented and are used to cancel the power frequency electromagnetic fields in the direction of the z axis; cables 15*a* and 15*b* are y-z planarly oriented and are used to cancel the power frequency electromagnetic fields in the direction of the x axis. Cables 13*a* and 13*b* are orthogonal with respect to cables 14*a* and 14*b* and are orthogonal with respect to cables 15*a* and 15*b*; cables 14*a* and 14*b* are orthogonal with respect to cables 13*a* and 13*b* and are orthogonal with respect to cables 15*a* and 15*b*; cables 15*a* and 15*b* are orthogonal with respect to cables 13*a* and 13*b* and are orthogonal with respect to cables 14*a* and 14*b*.

Figure 6:
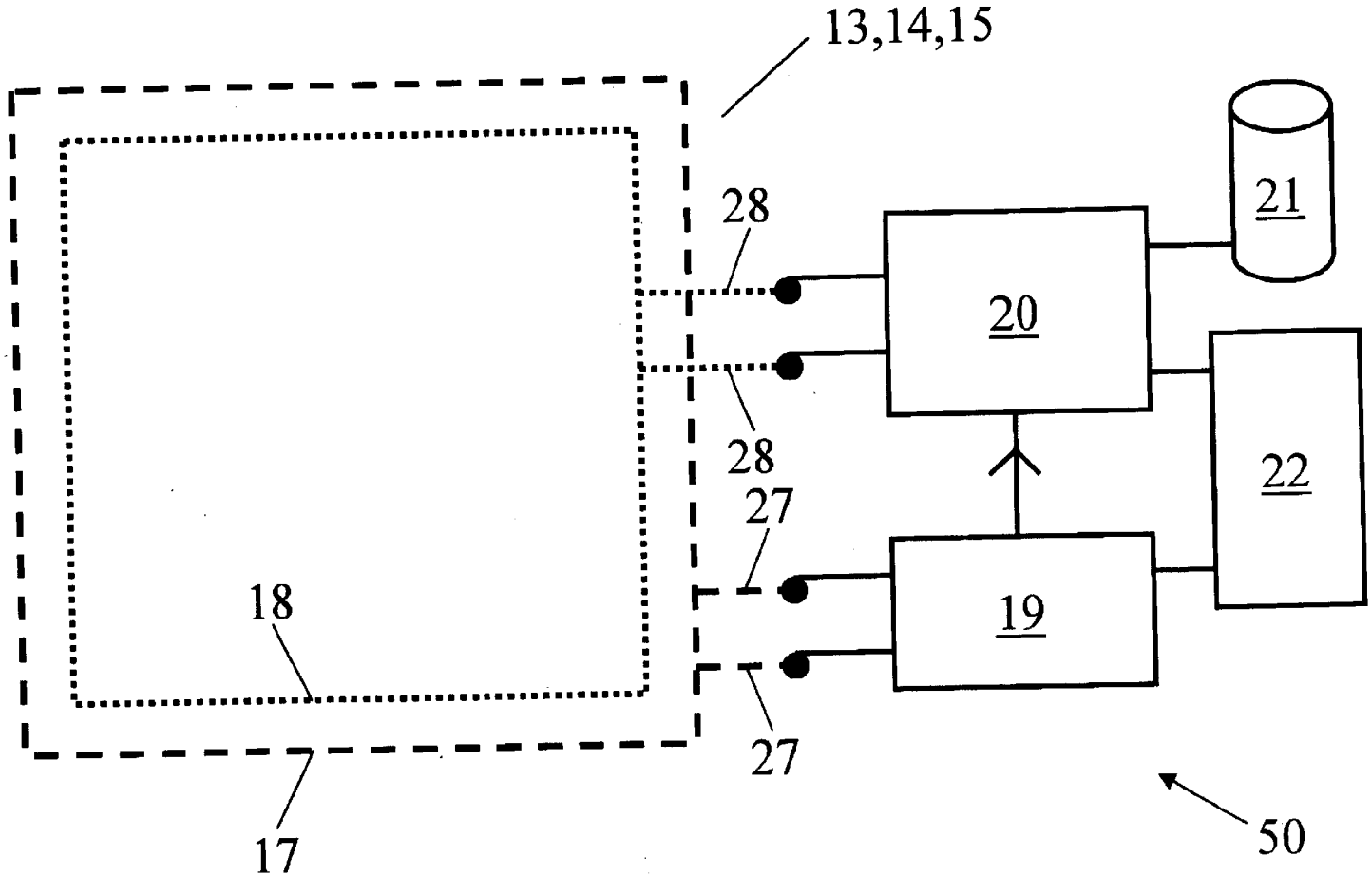
FIG. 6 is a block diagram of a typical active feedback control subsystem in accordance with the present invention, particularly illustrating effectuation in association with a closed-circuit cable such as shown in FIG. 1 through FIG. 4.

With reference to FIG. 6, the present invention's power frequency electromagnetic field compensation system typically includes at least six "subsystems." One such inventive subsystem is shown in FIG. 6. The inventive system embodiment depicted in FIG. 1 through FIG. 5 has six subsystems 50. Each subsystem 50 includes a cable (e.g., a cable 13*a*, or a cable 13*b*, or a cable 14*a*, or a cable 14*b*, or a cable 15*a*, or a cable 15*b*) and two amplifiers (e.g. a voltage amplifier 19 and a power amplifier 20). The two amplifiers are connected to each other. The cable is divided, in effect, into two groups of conductors (at least one conductor in each group), one of which is connected to the first amplifier (e.g., voltage amplifier 19) and the other of which is connected to the second amplifier (e.g., power amplifier 20). The combination of the first conductors group and the first amplifier represents a first circuit (e.g., "sensing" circuit 17). The combination of the second conductors group and the second amplifier represents a second circuit (e.g., "driving" or "compensating" circuit 18). Each conductor group consists of one or more conductors. If a conductor group consists of plural conductors, then the conductors within the conductor group are connected with each other in series. Preferred inventive practice may provide that each conductor group consist of plural conductors connected in series with respect to each other.

In accordance with the present invention, before the power frequency electromagnetic fields can be cancelled, each of their magnitudes in a specific direction must be measured. As illustrated in FIG. 6, the cable shown can be conceived to represent a sensing/compensating cable loop such as one of the six sensing/compensating cable loops shown in FIG. 1 through FIG. 5, viz., cable 13*a*, cable 13*b*, cable 14*a*, cable 14*b*, cable 15*a* or cable 15*b*. This sensing/compensating loop is a closed electrical circuit which is formed by a multi-conductor electric cable 13, 14 or 15.

In each sensing/compensating loop, a first group or portion (e.g., a first half) of the conductors are connected in series with each other, and a second, separate group or portion (e.g., a second half) of the conductors are connected in series with each other. This wiring configuration of the conductors forms two separate circuits 17 and 18 within the cable 13/14/15. One circuit in cable 13/14/15 is "sensing" circuit 17, which represents a sensing loop component (comprising one or more sensing windings) of the compensating/sensing cable 13/14/15 loop; the other circuit in cable 13/14/15 is "compensating" (or "drive") circuit 18, which represents a compensating loop component (comprising one or more compensating windings) of the compensating/sensing cable 13/14/15 loop. Thus, cable 13/14/15 includes sensing circuit 17 and compensating circuit 18, which are connected to sensing output leads 27 and drive input leads 28, respectively.

The two sensing leads 27 from sensing circuit 17 are connected to the input of a voltage amplifier 19 (e.g., a voltage amplifier ranging between 30 Hz and 3 KHz). The voltage at the sensing leads 27 and the output of the voltage amplifier 19 are proportional to the time rate-of-change in the total magnetic flux inside the cable 13/14/15 loop. This can be expressed mathematically as $$V \propto \frac{d\Phi}{dt} \tag{1}$$

where V represents the voltage at the sensing output leads 27 and of the cable 13/14/15 loop, Φ is the total flux inside the cable 13/14/15 loop, and t is time. This voltage is amplified and high-pass filtered by the voltage amplifier 19 before it is passed to the power (driving) amplifier 20, which is connected to an electrical power (current) source 21. The number of conductors wired in series for the sensing circuit 17 follows standard search-coil designs, and depends on the required flux sensitivity at the lowest frequency of operation.

The input to the power amplifier 20 is a voltage proportional to the AC magnetic flux measured by the sensing circuit 17 inside the cable 13/14/15 loop. The output of the power amplifier 20 is connected to the input leads of the compensating circuit 18 inside the cable 13/14/15 loop. Power amplifier 20 (e.g., a power amplifier ranging between 30 Hz and 3 KHz) supplies current to compensating circuit 18, which in turn generates its own magnetic field and flux. The flux measured by sensing circuit 17 is the sum of that generated by compensating circuit 18 and that produced by the electromechanical device being inventively compensated, viz., motor/generator 11. The gain and phase of the two amplifiers 19 and 20 are adjusted by a controller 22 so that current is driven into the two drive input leads 28 so as to produce zero voltage at the two sensing output leads 27. When this condition is reached, the total flux rate-of-change through the cable 13/14/15 loop is zero. A closed-circuit feedback circuitry system is thus inventively perpetuated so as to cancel the aggregate power frequency electromagnetic field emanating from motor/generator 11.

Still with reference to FIG. 6 and again with reference to FIG. 4 and FIG. 5, since the six compensating cable loops (cable 13*a* loop, cable 13*b* loop, cable 14*a* loop, cable 14*b* loop, cable 15*a* loop, cable 15*b* loop) form an imaginary box-shaped closed surface ("electromagnetic control surface") 30 around the motor/generator 11 device, the driving of the flux to zero inside each of all six cable loops results in no (zero) net flux leaving the imaginary closed surface. Electromagnetic control surface 30 is the approximate rectangular parallelepiped (box-shaped) geometric figure described by the six cable loops. Electromagnetic control surface 30 is not defined by a material physical structure but, rather, is defined by electromagnetic physical phenomena. The six cable loops constitute the six edges of box-shaped electromagnetic control surface 30. The present invention's compensation system is thereby characterized by an electromagnetic control volume (three-dimensional space) 32 which is exteriorly bounded by electromagnetic control surface 30, a box-shaped enclosure of an electromagnetic kind.

Each of the six cable loops has corresponding thereto a planar electromagnetic control sub-surface 31 which represents a side of the box-shaped control surface 30. In FIG. 4, one of the six control sub-surfaces 31 (the x-z planarly oriented control sub-surface indicated as sub-surface $\mathbf{31}_1$ in FIG. 5) is shaded for illustrative purposes. The six electromagnetic control sub-surfaces are indicated as sub-surfaces $\mathbf{31}_1$, $\mathbf{31}_2$, $\mathbf{31}_3$, $\mathbf{31}_4$, $\mathbf{31}_5$ and $\mathbf{31}_6$ in FIG. 5. In shipboard applications, because no net flux emanates from electromagnetic control surface 30, no net flux enters the water below the ship. The number of conductors connected in series for the compensating circuit 18 follows standard degaussing coil design procedures, and depends on the peak field/current to be generated by the cable 13/14/15 loop and the available power of the power (driving) amplifier 20.

Generally speaking, there are several practical considerations that must be taken into account when implementing a power frequency electromagnetic field compensation system in accordance with the present invention. Firstly, depending on any of several geometrical parameters (e.g., the dimensions of the compensating cable 13/14/15 loops, the distance from the cable 13/14/15 loop to the electromechanical entity 11, the distance from the cable 13/14/15 loop and the electromechanical device 11 to the underwater threat sensor, etc.), it is possible for some magnetic flux leaked by the electromechanical device 11 to pass through one of the compensating cable 13/14/15 loops and then return through the same cable 13/14/15 loop. Under this circumstance, there could still be a significant field below the ship even though the net flux through the cable 13/14/15 loop is zero.

To minimize this effect, the sizes of the compensating/sensing loops should be reduced. For instance, each of the six sensing/compensating loops (cable 13*a* loop, cable 13*b* loop, cable 14*a* loop, cable 14*b* loop, cable 15*a* loop, cable

15*b* loop) can be divided into a plural number of smaller loops that cover the same area as the single larger one. Each of the smaller loops would have, associated therewith, its own controller 21, voltage amplifier 19 and power amplifier 20. Mathematical and physical scale models of the electromechanical device 11 and the present invention's compensation system can be effected in accordance with the present invention, using typical electrical engineering artistic technique, in order to determine or fix the size(s) and number(s) of sensing/compensating loops.

In this regard, it is to be understood that applicability of the present invention is not limited in terms of dimensions or numbers of sensing/compensating loops, provided that there is a plurality of sensing/compensating loops in each of the three orthogonal directions. Thus, inventive practice requires: at least two sensing/compensating loops oriented in a first (e.g., x-z planar) orthogonal direction; at least two sensing/compensating loops oriented in a second (e.g., x-y planar) orthogonal direction; and, at least two sensing/compensating loops oriented in a third (e.g., y-z planar) orthogonal direction. According to various inventive embodiments, there may be two or several or even numerous sensing/compensating loops in any given orthogonal direction. The numbers of sensing/compensating loops need not match in all three orthogonal directions; hence, there can be two equal, three equal or totally unequal numbers of sensing/compensating loops among the three orthogonal directions.

According to typical inventive practice, for each plurality of sensing/compensating loops in a given orthogonal direction, a first sensing/compensating loop (or group of sensing/compensating loops) will be situated at or near (exterior with respect to) one extremity of the device being compensated, while a second sensing/compensating loop (or group of sensing/compensating loops) will be situated at or near (exterior with respect to) the opposite extremity of the device being compensated. It is preferable and perhaps critical that the present invention be practiced so as to completely surround, encompass or envelop (e.g., "box in") the electrical device being compensated, in a manner such as illustrated in FIG. 4 and FIG. 5. In the, light of the instant disclosure, the ordinarily skilled artisan will be capable of practicing the present invention with a sufficient degree of understanding pertaining to sizes, numbers and spatial relationships of sensing/compensating loops.

Another practical problem that must be addressed in implementing the present invention's power frequency electromagnetic field compensation system is the noise present in the output of the sensing circuit 17. If the present invention's compensation system were stationary and not located on a moving platform, then the noise level of the inventive system would be dominated by the thermal noise of the copper used in the sensing circuit 17 and the input noise level of voltage amplifier 19. However, this noise would be swamped by that produced from the movement and vibration of the sensing loop within the earth's magnetic field. The vibration noise would dominate primarily at the lower frequencies.

Through proper selection of the gain and lower cutoff frequency of the pass-band of amplifiers 19 and 20, the vibration noise below 60 Hz can be reduced significantly or eliminated altogether. In addition, the sensitivity of the sensing loop component decreases with frequency, as would be expected from Equation (1). Therefore, the lowest operating frequency for the present invention's electromagnetic field compensation system on a moving platform will, in most cases, be determined by the vibration noise.

If all sensing/compensating loops in the inventive compensation system are active simultaneously, instabilities in the system may form that cannot be removed through gain adjustments in the amplifiers. It is well known from one of Maxwell's equations, $\nabla\overline{B}=0$, that the total magnetic flux entering or leaving a closed surface is always zero. However, due to noise in the present invention's compensation system, the sum of all the flux measured by the sensing circuits 17 will not be zero. As a result, the inventive system will try to compensate the noise and force the total flux to zero. The inventive system will oscillate during its attempt to force the total flux to zero, which it cannot achieve since the "noise flux" is not real and will not sum to zero.

To avoid this problem, one of the inventive system's sensing/compensating loops should be unenergized. This inactivity of a single sensing/compensating loop will not have an adverse effect, since the total flux through the disabled loop will be small or zero if the flux through the remaining active sensing/compensating loops are controlled to zero. The disabled sensing/compensating loop can also serve as a spare in the event of failure of one of the other sensing/compensating loops.

Ideally, the present invention's compensation system should not be near any other source of power frequency electromagnetic fields that are outside its electromagnetic control surface 30. According to some inventive applications, a plurality of power frequency devices can be compensated by effecting a unified compensation system which bounds or circumscribes every such device; that is, if there are two or more to-be-compensated power frequency devices located in close proximity, then a single inventive compensation system preferably will be placed around all of the devices. In fact, it may be desirable to practice the present invention on a considerably larger scale; for instance, for some inventive applications, it may be desirable to cover the ship's hull with coils and cancel the power frequency fields from the entire vessel simultaneously. In more typical inventive applications, the field from a single isolated machinery item is all that must be compensated.

Although shipboard applications are emphasized in the present disclosure, it is to be understood that there are numerous alternative embodiments and applications in accordance with the present invention. For instance, the present invention's power frequency compensation system could be used in the laboratory to cancel the electromagnetic fields of nearby items that are stationary or immovable, but which are interfering with sensitive measurements. For such applications, an extremely sensitive laboratory version of the present invention's power frequency compensation system can be realized by using super-conducting cable for both the sense and compensating circuits.

It is additionally noted that there is no limitation, in principal, to the highest frequency for applying the present invention's compensation system, as long as the wavelength of the electromagnetic field being compensated is much greater than the largest dimension of any loop in the system. Practically, however, the power amplifier 20 must be capable of driving the inductive load of the compensating circuit 18 at the higher frequencies. Thus, the present invention will work at any frequency, provided that that the frequency is high enough to obtain a good signal-to-noise ratio on the sensing component of the sensing/compensating loop, and low enough that the maximum size of both the sensing component and the compensating component of the sensing/compensating loop represents a small fraction of the wavelength.

Figure 7:
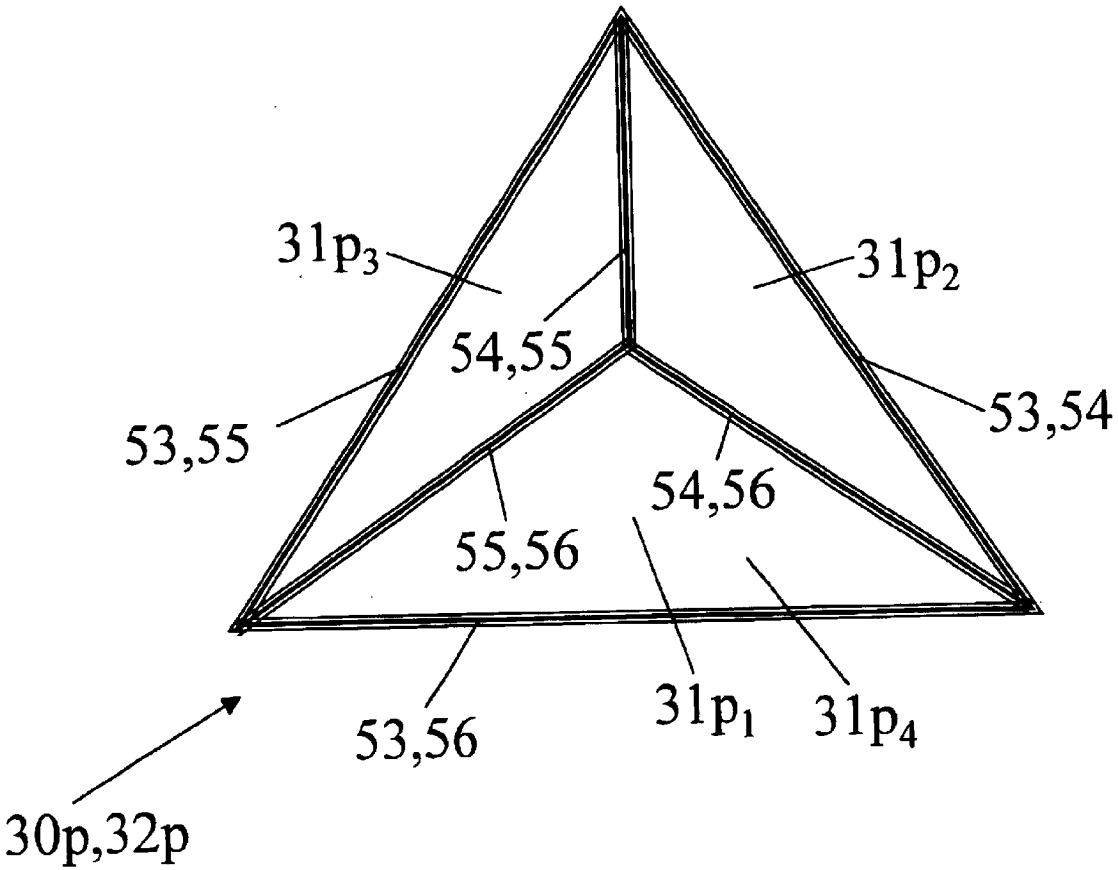
FIG. 7 is a diagrammatic perspective view, similar to the view shown in FIG. 5, of another embodiment of the present invention, wherein four closed-circuit cables are respectively situated at four different orientations so as to describe a pyramidal polyhedron having four triangular sides.

Although emphasis has been placed herein on the definition of a rectangular parallelepiped shape by means of three parallel pairs of orthogonal planes defined by the corresponding cable loops, it is to be understood that the definition of practically any closed or substantially closed three-dimensional geometric shape (e.g., polyhedron) is possible according to the present invention. The planar sub-surfaces defined by the cable loops can together constitute an enclosure characterized by any of a variety of three-dimensional shapes. For instance, with reference to FIG. 7, four cable loops 53, 54, 55 and 56 can be constructed so that the corresponding geometric planes defined thereby form a polyhedron having four triangular sides, i.e., a pyramidal electromagnetic control surface 30*p* having a triangular base. Pyramidal electromagnetic control surface 30*p* delimits electromagnetic control volume 32*p*. The four planar control sub-surfaces corresponding to the four cable loops are indicated in FIG. 7 as sub-surfaces $\mathbf{31}p_1$, $\mathbf{31}p_2$, $\mathbf{31}p_3$ and $\mathbf{31}p_4$. Typically according to the present invention, such a four-sided polyhedral control surface would involve four subsystems, as each cable loop would be included in a separate subsystem.

The polyhedral figure can have any number of sides greater than three. That is, inventive practice permits n-sided polyhedral figures, wherein n is greater than or equal to four. It is not necessary that the planar control sub-surfaces defined by the cable loops be oriented in an orthogonal manner with respect to each other. Nor is it necessary that any given cable loop define a particular two-dimensional (e.g., rectangular or triangular) shape. Nor is it necessary, according to inventive practice, that there be only three orientations of the planar control sub-surfaces defined by the cable loops. In accordance with the present invention, a cable loop can define any regular or irregular shape in two dimensions, there can be three or more orientations of the sub-surfaces defined by the cable loops, and these orientations can be at any angle or angles relative to each other.

Other embodiments of this invention will be apparent to those skilled in the art from a consideration of this specification or practice of the invention disclosed herein. Various omissions, modifications and changes to the principles described may be made by one skilled in the art without departing from the true scope and spirit of the invention which is indicated by the following claims.

What is claimed is:

1. Degaussing apparatus for use in relation with an electrical device, said degaussing apparatus comprising at least four circuitous combinations, each said circuitous combination including a coil unit, a voltage amplifier and a power amplifier;

wherein as to each said circuitous combination: said coil unit lies in a geometric plane and defines a geometric polygonal planar shape that borders upon said electrical device; said coil unit includes two conductor means; a first said conductor means is connected with the input of said voltage amplifier; a second said conductor means is connected with the output of said power amplifier; said voltage amplifier is connected with said power amplifier; said voltage amplifier produces a voltage proportional to the magnetic flux sensed as associated with said electrical device, said magnetic flux passing perpendicularly through said geometric polygonal planar shape defined by said coil unit; said power amplifier produces a current counteracting said voltage produced by said voltage amplifier so as to neutralize said magnetic flux passing perpendicularly through said geometric polygonal planar shape defined by said coil unit;

wherein the respective said geometric polygonal planar shapes defined by said coil units together form a geometric polyhedral enclosure for said electrical device whereby the aggregate effect of said neutralizations of said magnetic flux is to prevent the escape of any said magnetic flux from said geometric polyhedral enclosure.

2. Degaussing apparatus as defined in claim 1, wherein sad imaginary enclosure is formed by at least six said imaginary planes so as to define a parallelepiped shape.

3. Degaussing apparatus as defined in claim 1, wherein said imaginary enclosure is formed by at least four said imaginary planes so as to define a pyramid shape.

4. Degaussing apparatus as defined in claim 1, wherein said imaginary enclosure defines a polyhedron shape.

5. A system for counteracting the power frequency electromagnetic field emanating from an entity said system comprising at least six subsystems; each said subsystem including a first amplifier, a second amplifier, and at least one cable; said system thereby including at least six said cables; each said cable having plural conductors and being circumferntially disposed proximate said entity so as to approximately describe a corresponding geometric plane which is approximately oriented in one of three orthogonal directions; each said orthogonal direction being characterized such that each of at least two said cables approximately describes a said corresponding geometric plane approximately oriented in said orthogonal direction; said at least six cables approximately describing at least six said corresponding geometric planes so as to approximately describe a rectangular parallelepiped which is formed by said at least six corresponding geometric planes and which at least substantially encompasses said entity; said system rendering approximately equal to zero the magnetic flux passing through each said cable in the direction orthogonal to said corresponding geometric plane; said system thereby at least substantially canceling said power frequency electromagnetic field emanating from said entity; wherein, in each said subsystem:

said first amplifier is counted to said second amplifier;

a first group, of at least one said conductor, is connected to said first amplifier so that said first amplifier senses said magnetic flux passing through said cable in the direction orthogonal to said corresponding geometric plane and so that said first amplifier generates a voltage signal approximately proportional to said magnetic flux passing through said cable in the direction orthogonal to said corresponding geometric plane; and a second group, of at least one said conductor, is connected to said second amplifier so that said second amplifier receives said voltage signal from said first amplifier and generates a current signal which drives said second group of said conductors so that said voltage signal approximately equals zero, said magnetic flux passing through said cable in the direction orthogonal to said corresponding geometric plane thereby equaling zero.

6. The system according to claim 5, wherein in each said subsystem approximately one-half of said conductors belong to said first group and approximately one-half of said conductors belong to said second group.

7. The system according to claim 5, wherein each said sub further comprises an electrical power source, connected to said second amplifier, for providing electrical current for said second amplifier.

8. The system according to claim 5, wherein each said subsystem further comprises adjustment means, connected to said first amplifier and said second amplifier, for adjusting the gun and phase of said first amplifier and said second amplifier.

9. The system according to claim 5, wherein each said cable is sufficiently large for circumscribing said entity.

10. The system according to claim 5, wherein said first group is of plural said conductors connected in series, and wherein said second group is of plural said conductors connected in series.

11. A method for countering the power frequency electromagnetic field emanating from an entity, said method comprising:

circumferentially disposing each of at least six cables proximate said entity so as to approximately describe a corresponding geometric plane which is approximately oriented in one of three orthogonal directions, each said cable having plural conductors, each said orthogonal direction being characterized such that each of at least two said cables approximately describes a said corresponding geometric plane approximately oriented in said orthogontal direction, said at least six cables approximately describing at least six said corresponding geometric planes so as to approximately describe a rectangular parallelepiped which is formed by said at least six corresponding geometric planes and which at least substantially encompass said entity; and with rest to each said cable:

connecting a corresponding first group, of at least one said conductor, to a corresponding first amplifier so that said corresponding first amplifier senses the magnetic flux passing through each said cable in the direction orthogonal to said corresponding geometric plane, and so that said corresponding first amplifier generates a voltage signal approximately proportional to said magnetic flux; and connecting a corresponding second group, of at least one said conductor, to a corresponding second amplifier so that said corresponding second amplifier receives said voltage signal from said corresponding first amplifier and generates a current signal which drives said second group of said conductors so that said voltage signal approximately equals zero, said magnetic flux passing through said cable in the direction orthogonal to the corresponding said geometric plane thereby equaling zero;

wherein said system readers approximately equal to zero the magnetic flux passing through each said cable in the direction orthogonal to said corresponding geometric plane, said system thereby at least substantially canceling said power frequency electromagnetic field emanating from said entity.

12. The method according to claim 11, wherein in each said cable approximately one-half of said conductors belong to said first group and approximately one-half of said conductors belong to said second group.

13. The method according to claim 11, further comprising with rest to each said cable, connecting an electrical power source to said corresponding second amplifier, for providing electrical current to said corresponding second amplifier.

14. The method according to claim 11, further comprising, with rest to each said cable, connecting adjustment means to said corresponding first amplifier and said corresponding second amplifier, for adjusting the gain and phase of said corresponding first amplifier and said corresponding second amplifier.

15. The method according to claim 11, wherein each said cable is large enough to circumscribe said entity.

16. The method according to claim 11, wherein said first group is of plural said conductors connected in series, and wherein said second group is of plural said conductors connected in series.

* * * * *